US005310377A

United States Patent [19]

Joja

[11] Patent Number: 5,310,377

[45] Date of Patent: May 10, 1994

[54] ILLUMINATED SOUND PRODUCING TOY

[75] Inventor: Tetsuya Joja, Tokyo, Japan

[73] Assignee: Tomy Company, Ltd., Tokyo, Japan

[21] Appl. No.: 913,384

[22] Filed: Jul. 15, 1992

[30] Foreign Application Priority Data

Jul. 31, 1991 [JP] Japan ..... 3-68367[U]

[51] Int. Cl.[5] ..... A63H 33/22; A63H 33/26; F21V 33/00; G09F 13/12

[52] U.S. Cl. ..... 446/219; 446/397; 446/485; 362/141; 40/219

[58] Field of Search ..... 446/219, 175, 227, 397, 446/404, 408, 484, 485; 362/140, 141, 806, 807, 808; 40/219, 900, 433

[56] References Cited

U.S. PATENT DOCUMENTS

| | | | |
|---|---|---|---|
| 2,151,600 | 3/1939 | Janzen | 40/433 |
| 2,554,063 | 5/1951 | Serrine | 362/806 X |
| 4,072,314 | 2/1978 | Rosen et al. | 446/404 X |
| 4,373,918 | 2/1983 | Berman | 446/408 X |
| 4,858,079 | 8/1989 | Ohashi | 446/485 X |

FOREIGN PATENT DOCUMENTS

| | | | |
|---|---|---|---|
| 693130 | 8/1964 | Canada | 446/408 |

*Primary Examiner*—David N. Muir
*Attorney, Agent, or Firm*—Staas & Halsey

[57] ABSTRACT

An illuminated sound producing toy comprising a base frame, a drive mechanism, a sound producing mechanism, an opening formed in the base frame, a mirror fitted in the opening, an electric lamp, a switch and a first light transmitting board. The sound producing mechanism is capable of being driven by the drive mechanism and the switch turns the electric lamp ON and OFF. The first light transmitting board is positioned generally between the mirror and the electric lamp and is driven through a predetermined motion by the drive mechanism. The first light transmitting board comprises an illustration display area so that illustrations can be seen through the mirror means only when the electric lamp is ON.

15 Claims, 6 Drawing Sheets

ILLUMINATED SOUND PRODUCING TOY

BACKGROUND OF THE INVENTION

1. Field of the Invention

The present invention relates generally to amusement devices and more specifically to an illuminated sound producing toy.

2. Description of the Related Art

Recently, a music box toy has been proposed wherein while the music box is being operated, an electric lamp positioned in the interior of a patterned milk-white dome turns ON. At the same time, the dome rotates, thereby allowing illuminated moving patterns to be displayed on the dome In such a music box toy, since moving illuminated patterns are displayed while the music plays, the user can enjoy not only music but also the images created by the moving patterns. It is also possible to use the music box toy as a room lamp because the dome is illuminated while the music box plays.

However, when the music box is not playing, the value of this conventional music box toy is only ornamental, deficient in any utility value.

Additionally, the patterns which are displayed on the dome when the music box operates can be seen from the exterior even when the music box is not operating. Therefore, the display of the moving illuminated patterns is easily anticipated, and the viewer is not surprised.

SUMMARY OF THE INVENTION

The present invention has been accomplished in view of the above-mentioned problems, and it is the object of the invention to provide a sound producing toy which is useful when it is not being operated, and provides unexpected results when it is being operated.

The above mentioned objects are accomplished by providing an illuminated sound producing toy comprising a base frame, a drive mechanism, a sound producing mechanism, an opening formed in the base frame, a mirror means fitted in the opening, an electric lamp, a switch means and a first light transmitting board. The sound producing mechanism is capable of being driven by the drive mechanism and the switch means turns the electric lamp ON and OFF. The first light transmitting board is positioned generally between the mirror means and the electric lamp and is driven through a predetermined motion by the drive mechanism. The first light transmitting board comprises an illustration display area so that illustrations can be seen through the mirror means only when the electric lamp is ON.

According to the above, when the electric lamp in the base frame is OFF, the interior of the base frame is dark, so the patterns on the light transmitting board do not appear in the half mirror. In this state, the half mirror functions as a total reflection-type mirror, and the light transmitting board cannot be seen.

When the electric lamp is turned ON, the interior of the base frame becomes illuminated and the patterns on the light transmitting board can be seen through the half mirror. If the light transmitting board is operated by the drive mechanism, moving patterns are seen through the half mirror. At this time, the light of the electric lamp is emitted through the half mirror, therefore the toy can also be used as a room lamp.

Further, if semi-transparent decorations are inlaid around the half mirror, and color patterns are attached to the light transmitting board in positions corresponding to the decorations, it is possible to enjoy not only the patterns displayed in the half mirror but also the changes in color of the decorations inlaid around the half mirror. These changes in color of the decorations have a soothing effect.

These and other features and advantages of the present invention will become more apparent with reference to the following detailed description and drawings. However, the drawings and descriptions are merely illustrative in nature and not restrictive.

description of the preferred embodiment

Hereinafter, an embodiment of the illuminated sound producing toy according to the present invention will be described in detail with reference to the drawings.

Figure 1:
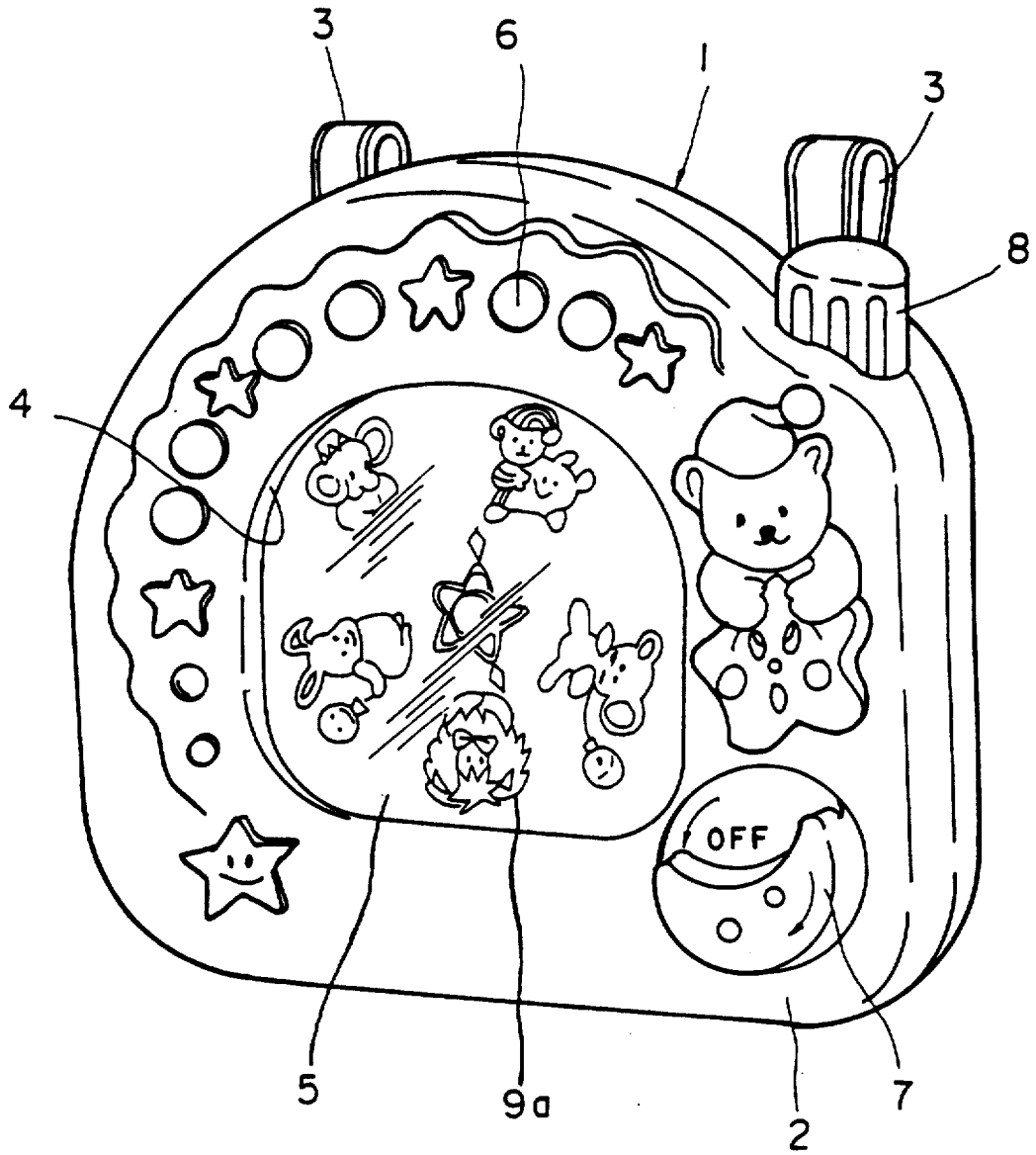
FIG. 1 is a perspective exterior view of the illuminated sound producing toy according to the present invention.

FIG. 1 illustrates a music box toy as an example of the illuminated sound producing toy. This music box toy, indicated at 1, can be suspended from, for example, a baby bed, using belts 3 which are attached to the back of a base frame 2.

A window 4 is formed centrally in the front of the base frame 2 of the music box toy 1, and a half mirror 5 is mounted just behind the window 4. A large number of semi-transparent decorations 6 are inlaid around the left upper portion of the window 4, and an electric lamp lighting knob 7 is positioned in the lower right portion of the base frame 2, while in the upper right portion of the base frame 2 there is mounted a spiral spring winding knob 8.

In the music box toy 1, the music box is played by rotating the spiral spring winding knob 8. This also turns ON the lamp and therefore the characters **9*a* are displayed through the half mirror 5 approximately simultaneously with the playing of the music. The characters 9*a* move around the center of the half mirror 5, and the decorations 6 glisten and continuously change color. When the playing of the music is over, the characters 9*a* disappear from the half mirror 5, and the brilliance of the decorations 6** is lost.

When the electric lamp lighting knob 7 is operated, the characters 9a are displayed through the half mirror 5 and the decorations 6 glisten. In this case, however, the music is not played and the characters 9a which are displayed through the half mirror do not move. Also, the decorations 6 do not change color.

An internal structure of the illuminated sound producing toy 1 will be described below with reference to FIGS. 2 through 8.

Figure 2:
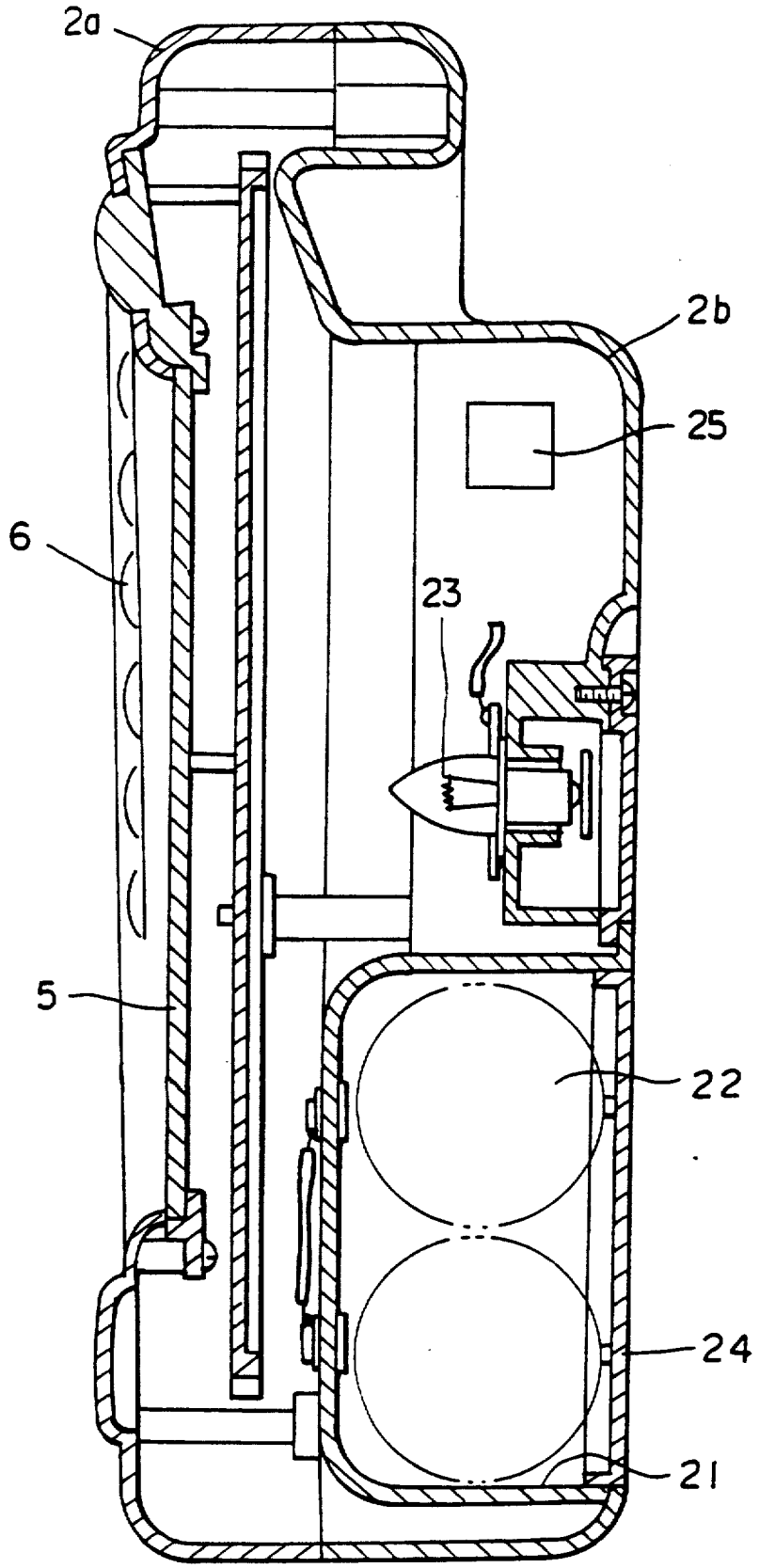
FIG. 2 is a vertical cross-sectional view of the illuminated sound producing toy according to the present invention.

As shown in FIG. 2, the base frame 2 comprises a front frame 2a and a rear frame 2b. In the rear frame 2b there is formed a concave portion 21 serving as a battery receptacle, and batteries 22 are set in the concave portion 21. An electric lamp 23 mounted to the rear frame 2b is powered by the batteries 22. The reference numeral 24 in FIG. 2 denotes a lid for covering the battery receptacle concave portion 21.

Figure 3:
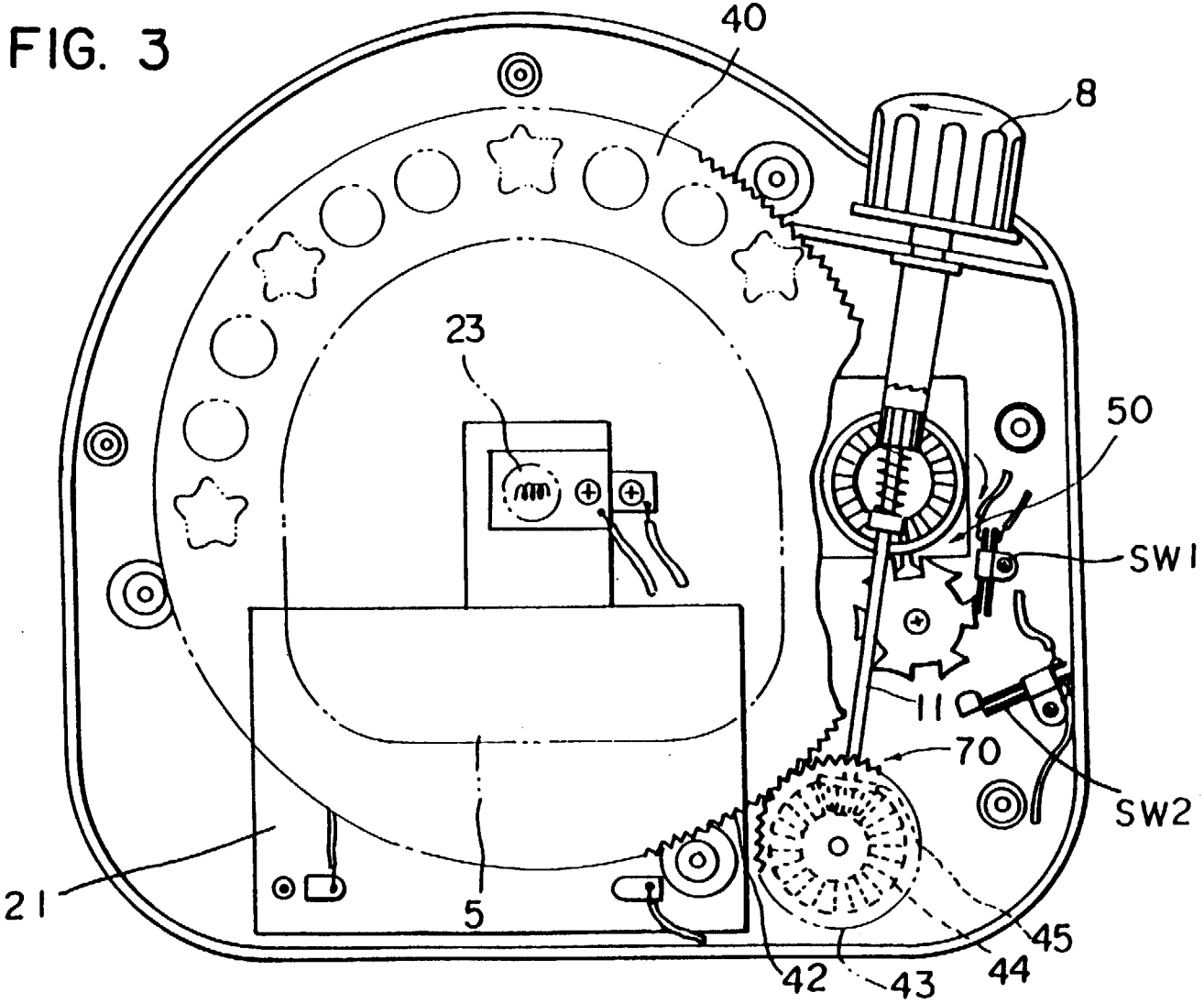
FIG. 3 is a front cross-sectional view of the illuminated sound producing toy according to the present invention.

Within the base frame 2, as shown in FIG. 3, there are mounted an automatic switch mechanism 50 having switch SW1, a manual switch mechanism (FIG. 7) having switch SW2, a music box (25 in FIG. 2), a light transmitting board 40 and a light transmitting board driving mechanism 70.

The music box used in this embodiment is driven by a spiral spring mechanism. A spiral spring 10 (FIG. 4), which is used for driving the music box, is wound by the spiral spring winding knob 8.

Figure 4:
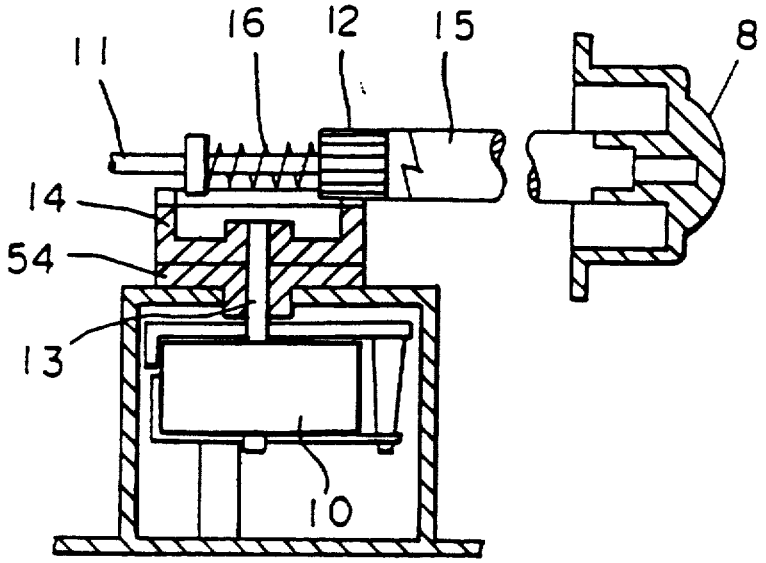
FIG. 4 is a longitudinal cross-sectional view of a spiral spring winding mechanism used in the illuminated sound producing toy of the present invention.
Figure 5:
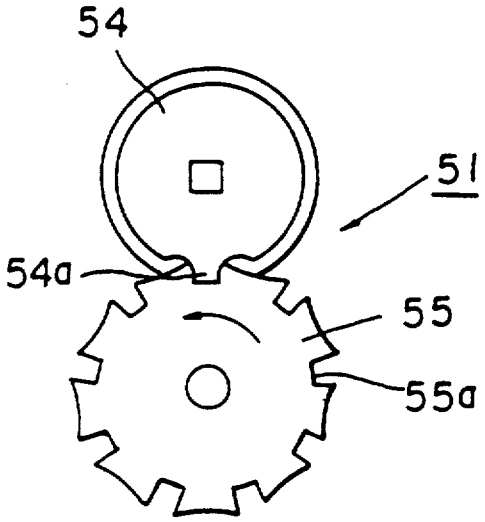
FIG. 5 is a plan view of a Geneva mechanism used in the illuminated sound producing toy of the present invention.

More specifically, as shown in FIG. 4, a rotatable shaft 11 is connected to the spiral spring winding knob 8, and a pinion 12 mounted on the shaft 11 meshes with a crown gear 14 mounted on the upper end of the spiral spring winding shaft 13. Consequently, the spiral spring 10 is wound by rotating the spiral spring winding knob 8.

A sleeve 15 is fitted on the rotatable shaft 11. The pinion 12, which is movable in the axial direction of the shaft 11, is pushed against the sleeve 15 by means of a spring 16. The contact surfaces of the sleeve 15 and the pinion 12 are formed with retaining teeth which are engageable with each other. The retaining teeth mesh with each other when the spiral spring winding knob 8 is turned in the winding direction, and the meshing is released when the knob 8 is turned in the opposite direction. Thus, the sleeve 15 and the pinion 12 constitute a simple one-way clutch.

Figure 6:
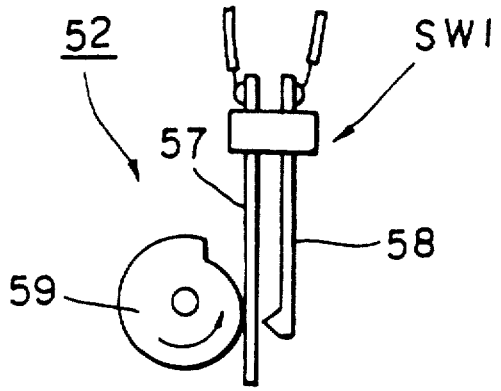
FIG. 6 is a plan view of a cam mechanism used in the illuminated sound producing toy of the present invention.

The switch mechanism 50 for lighting the electric lamp comprises a switch SW1, a Geneva mechanism 51 (FIG. 5) for opening and closing the switch SW1, and a cam mechanism 52 (FIG. 6).

The Geneva mechanism 51 comprises a driving wheel 54 mounted on an intermediate part of the spiral spring winding shaft 13 and an intermittent gear 55 mounted next to the driving wheel 54. Projecting from the out peripheral surface driving wheel 54 is a projection 54a, while in the outer peripheral surface of the intermittent gear 55 there are grooves 55a in which the projection 54a of the driving wheel 54 fits. In the Geneva mechanism 51, the projection 54a is fitted in a groove 55a every time the driving wheel 54 rotates once, whereby the intermittent gear 55 is rotated in an intermittent manner.

A plate cam 59 of the cam mechanism 52 is mounted coaxially with the intermittent gear 55. The electroconductive contact pieces 57 and 58 comprise the switch SW1. One contact piece 57 is normally in contact with the peripheral surface of the plate cam 59. When the switch SW1 is OFF, the contact pieces 57 and 58 are not in contact with each other. The plate cam 59 has a profile such that when it rotates through force supplied by the Geneva mechanism 51, as the spiral spring 10 is being charged and wound, the electroconductive contact piece 57, which follows a cam surface of the plate cam 59, engages with the other electroconductive contact piece 58. When the spiral spring 10 loosens and discharges and the plate cam 59 returns to its original position, the contact piece 57 disengages with contact piece 58 by virtue of its own resilience. The switch SW1 turns the electric lamp ON and OFF by engagement and disengagement, respectively, of the contact pieces 57 and 58.

Figure 7:
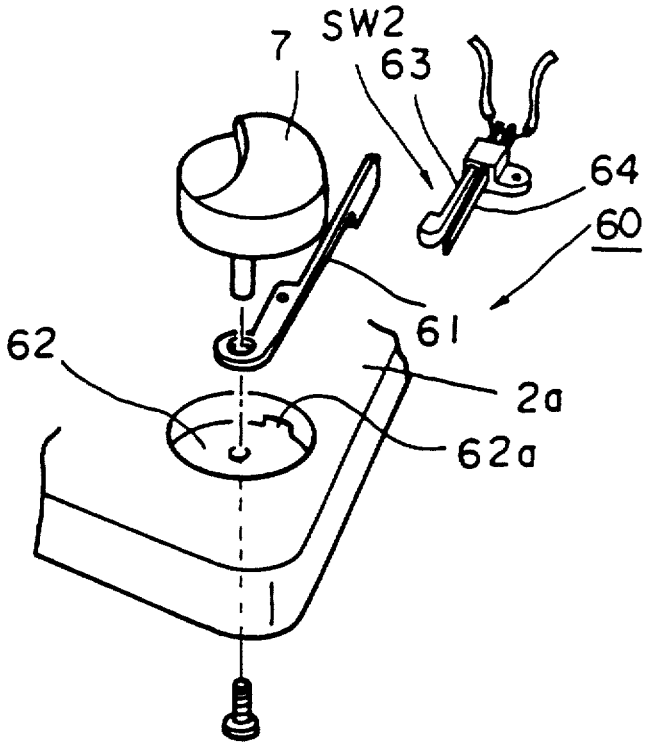
FIG. 7 is an exploded perspective view of another switch mechanism used in the illuminated sound producing toy of the present invention and FIG. 8 is a cross-sectional view of a light transmitting board used in the illuminated sound producing toy of the present invention.

The other switch mechanism 60 for lighting the electric lamp comprises a switch SW2 and an actuating lever 61 which is operated by the electric lamp lighting knob 7, as shown in FIG. 7.

A base end side of the actuating lever 61 extends into a recess 62 formed in the front frame 2a in which the electric lamp lighting knob 7 sits, and is attached to a shaft of the electric lamp lighting knob 7. A front end side of the actuating lever 61 extends through an opening 62a into the interior of the base frame 2 and contacts with a electroconductive contact piece 62. The electroconductive contact piece 63 and another electroconductive contact piece 64 comprise the switch SW2. The electric lamp 22 is turned ON and OFF by engagement and disengagement, respectively, of the electroconductive contact pieces 63 and 64, which action is performed by the rotation of the electric lamp lighting knob 7.

Figure 8:
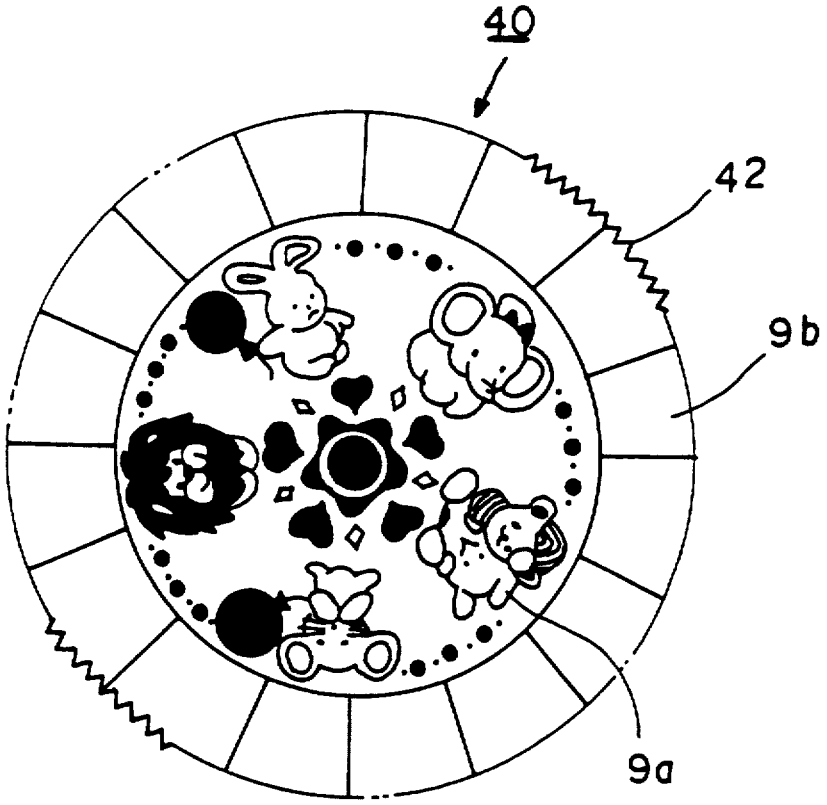

The light transmitting board 40 comprises a light transmitting disk, as shown in FIG. 8, and is supported by the rear frame 2b so as to be rotatable about a shaft (not shown). Various characters (illustrations) 9a are drawn on the surface of the light transmitting board 40, and around the characters 9a are provided color patterns 9b. The positions of the color patterns 9b correspond to the positions of the decorations 6 inlaid in the front frame 2a of the base frame 2.

A gear 42 is formed along the whole circumference of the light transmitting board 40 and it meshes with a spur gear 43, as shown in FIG. 3. Further, a spiral bevel gear 44, which is coaxial with the spur gear 43, meshes with a bevel gear 45 mounted on a front end of the rotatable shaft 11. Consequently, the rotation of the rotatable shaft 11 causes rotation of the light transmitting board 40 through the gears 45, 44, 43 and 42. The light transmitting board is supported rotatably by the surroundings and also from the front and rear.

The operation of the illuminated music box toy 1 of the present invention is now described.

In the illuminated music box toy 1, the spiral spring 10 is wound and charged by turning the spiral spring winding knob 8. At this time, the switch SW1 closes through the Geneva mechanism 51 and the cam mechanism 52, thus turning ON the electric lamp 23. At the same time, the characters 9a are displayed in the half mirror 5 and the decorations 6 glisten.

When the spiral spring winding knob 8 is released after winding the spiral spring 10, the energy accumulated in the spiral spring 10 is released. Thus, power is transmitted to both the music box (not shown) and the light transmitting board 40 through the rotatable shaft 11, whereby the music box is played, the characters 9a move around the center of the half mirror 5 and the decorations 6 continuously change color.

In this way, the energy stored in the spiral spring 10 is discharged and eventually the music box stops playing. Also, as the spiral spring 11 unwinds and discharges, the power is transmitted to the Geneva mechanism 51 and the cam mechanism 52, and upon completion of the playing of the music box, the switch SW1 opens and the electric lamp 22 is turned OFF. As a result, the characters 9a disappear from the half mirror 5 and the colored illumination of the decorations 6 is lost.

On the other hand, when the electric lamp lighting knob 7 is turned in one direction, the switch SW2 closes and the lamp 22 is turned ON, whereby the characters 9a are displayed in the half mirror 5 and the decorations 6 glisten. When the electric lamp lighting knob 7 is released or turned in the opposite direction, the switch SW2 opens and the lamp 22 is turned OFF. As a result, the characters 9a disappear from the half mirror 5 and the colored illumination of the decorations 6 is lost.

The following advantages are obtained by the illuminated music box toy 1 of the above-described embodiment.

In the illuminated music box toy 1 of the above embodiment, when the electric lamp 22 in the base frame 2 is OFF, the interior of the base frame 2 is dark, and the half mirror 5 becomes a fully reflective mirror.

Moreover, upon winding of the spiral spring 10, the electric lamp 22 in the base frame 2 is turned ON, and the patterns on the light transmitting board 40 positioned in front of the lamp 22, are displayed in the half mirror 5. Also, the characters 9a on the light transmitting board begin to rotate.

Further, since the electric lamp 22 can be turned ON independently of spiral spring 10, it can be utilized as a room light even when the music box is not being played.

Additionally, since the light transmitting decorations 6 are inlaid around the half mirror 5 fitted in the front face of the base frame 2 and the color patterns 9b are attached to the light transmitting board 40 in positions corresponding to the decorations 6, it is possible to enjoy not only the characters 9a displayed in the half mirror 5, but also the change in color of the decorations 6. Since this change in color appears through the semi-transparent decorations, it provides a soothing feeling to the viewer.

Although an embodiment of the present invention has been described above, the present invention is not limited to such embodiment, and various modifications may be made without departing from the scope of the present invention.

For example, in the illuminated music box toy 1 of the above embodiment, the light transmitting board 40 is rotated. However, other movements are possible by utilizing a gear mechanism, a link mechanism and a cam mechanism.

Moreover, two light transmitting boards 40 may be used, one under the other, each light transmitting board 40 being operated separately using a gear mechanism, a link mechanism and a cam mechanism.

Further, the present invention is not limited to music box toys, but is applicable to many different sound producing toys, including record toys, piano toys, electronic tone melody toys and talking toys.

What is claimed is:

1. A illuminated sound producing toy comprising:
a base frame;
a drive mechanism provided in said base frame;
a sound producing mechanism provided in said base frame and engaged to said drive mechanism;
mirror means fitted in base means:
an electric lamp;
switch means comprising;
an automatic switch mechanism for turning said electric lamp ON and OFF by force provided by said drive mechanism; and
a manual switch mechanism for turning said electric ON and OFF by force not provided by said drive mechanism; and
a first light transmitting board positioned generally between said mirror means and said electric lamp, said first light transmitting board being driven through a predetermined motion by said drive mechanism and comprising an illustration display area so that illustrations can be seen through said mirror means only when said electric lamp is ON.

2. An illuminated sound producing toy as claimed in claim 1, wherein semi-transparent decorations are inlaid in said base frame at positions at least partially surrounding said mirror means and said first light transmitting board further comprises a color pattern area in a position corresponding to said first semi-transparent decorations so that the light from the electric lamp travels through the color patterns and illuminates said semi-transparent decorations.

3. An illuminated sound producing toy as claimed in claim 1, wherein said drive mechanism comprises:
a spiral spring winding knob provided outside said base frame; and
a spiral spring capable of being charged by rotation of said spiral spring winding knob in a first direction.

4. An illuminated sound producing toy as claimed in claim 3, wherein said drive mechanism further comprises a one-way clutch positioned so that a force from rotation of said spiral spring winding knob in a second direction opposite the first direction is not transmitted to said spiral spring.

5. An illuminated sound producing toy as claimed in claim 1, wherein said predetermined motion said first light transmitting board moves through is a rotary motion.

6. An illuminated sound producing toy as claimed in claim 5, further comprising a circumferential gear along the circumference of said first light transmitting board and a spur gear driven by said drive mechanism, said circumferential gear meshing with said spur gear to enable said rotary motion of said first light transmitting board.

7. An illuminated sound producing toy as claimed in claim 1, wherein semi-transparent decorations are inhaled in said base frame at positions at least partially surrounding said mirror means and said first light transmitting board further comprises a color pattern area in a position corresponding to said first semi-transparent decorations so that the light from the electric lamp travels through the color patterns and illuminates said semi-transparent decorations.

8. An illuminated sound producing toy comprising:
a base frame;
a drive mechanism provided in said base frame;
a sound producing mechanism provided in said base frame and engaged to said drive mechanism;
mirror means fitted in base means;
an electric lamp;
switch means comprising;
an automatic switch mechanism for turning said electric lamp ON and OFF by force provided by said drive mechanism, said automatic switch mechanism turning said electric lamp ON at least when said sound producing mechanism is being driven by said drive mechanism; and a manual switch mechanism for turning said electric lamp ON and OFF by force not provided by said drive mechanism; and a first light transmitting board positioned generally between said mirror means and said electric lamp, said first light transmitting board being driven through a predetermined motion by said drive mechanism and comprising an illustration display area so that illustrations can be seen through said mirror means only when said electric lamp is ON.

9. An illuminated sound producing toy as claimed in claim 8, wherein said drive mechanism comprises:

a spiral spring winding knob provided outside said base frame; and a spiral spring capable of being charged by rotation of said spiral spring winding knob in a first direction.

10. An illuminated sound producing toy as claimed in claim 9, wherein said automatic switch mechanism comprises:

a driving wheel with a projection, said driving wheel being rotated in the first direction by said drive mechanism when said spiral spring is being charged, said driving wheel being rotated in a second direction opposite the first direction when said spiral spring is being discharged;

an intermittent gear with grooves which mesh with said projection of said driving wheel so that said intermittent gear is moved intermittently with each rotation of said driving wheel;

a plate cam with a radially uneven outer surface, said plate cam rotating integrally with said intermittent gear;

first and second electric contact pieces, the first electric contact piece being biased against said outer surface of said plate cam so that said first contact piece is out of contact with said second electric piece when said spiral spring is fully discharged and said first contact piece is in contact with said second contact piece when said spiral spring is at least partially charged.

11. An illuminated sound producing toy as claimed in claim 8, wherein semi-transparent decorations are inlaid in said base frame at positions at least partially surrounding said mirror means and said first light transmitting board further comprises a color pattern area in a position corresponding to said first semi-transparent decorations so that the light from the electric lamp travels through the color patterns and illuminates said semi-transparent decorations.

12. An illuminated sound producing toy as claimed in claim 8, wherein said drive mechanism comprises:

a spiral spring winding knob provided outside said base frame;

a spiral spring capable of being charged by a forward rotation of said spiral spring winding knob; and a one-way clutch positioned so that the force from a reverse rotation of the spiral spring winding knob is not transmitted to said spiral spring.

13. An illuminated sound producing toy as claimed in claim 8, wherein said predetermined motion said first light transmitting board moves through is a rotary motion.

14. An illuminated sound producing toy as claimed in claim 13, further comprising a circumferential gear along the circumference of said first light transmitting board and a spur gear driven by said drive mechanism, said circumferential gear meshing with said spur gear to enable said rotary motion of said first light transmitting board.

15. An illuminated sound producing toy as claimed in claim 8, wherein semi-transparent decorations are inlaid in said base frame at positions at least partially surrounding said mirror means and said first light transmitting board further comprises a color pattern area in a position corresponding to said first semi-transparent decorations so that the light from the electric lamp travels through the color patterns and illuminates said semi-transparent decorations.

* * * * *

UNITED STATES PATENT AND TRADEMARK OFFICE

CERTIFICATE OF CORRECTION

PATENT NO. : 5,310,377

DATED : May 10, 1994

INVENTOR(S) : Tetsuya Joja

It is certified that error appears in the above-indentified patent and that said Letters Patent is hereby corrected as shown below:

Col. 2, line 40, change "description of the preferred Embodiment" to --Description of the Preferred Embodiment--.

Col. 6, lines 49-50, change "inhaled" to --inlaid--.

Signed and Sealed this

Sixteenth Day of May, 1995

Bruce Lehman

BRUCE LEHMAN

*Commissioner of Patents and Trademarks*

*Attest:*

*Attesting Officer*